US006875010B1

(12) United States Patent
Oviatt

(10) Patent No.: US 6,875,010 B1
(45) Date of Patent: Apr. 5, 2005

(54) EXCESS GAS BURNER

(76) Inventor: William T. Oviatt, 177 N. 3rd St., Lander, WY (US) 82820

( * ) Notice: Subject to any disclaimer, the term of this patent is extended or adjusted under 35 U.S.C. 154(b) by 59 days.

(21) Appl. No.: 10/438,170

(22) Filed: May 14, 2003

Related U.S. Application Data

(60) Provisional application No. 60/380,368, filed on May 14, 2002.

(51) Int. Cl.[7] ..... F23H 5/00
(52) U.S. Cl. ..... 431/89; 431/12
(58) Field of Search ..... 431/89, 12, 18, 431/202

(56) References Cited

U.S. PATENT DOCUMENTS 3,990,428 A * 11/1976 O'Connor ..... 126/94
4,549,525 A * 10/1985 Narang ..... 122/14.21
4,664,096 A * 5/1987 Narang ..... 122/14.21
4,869,232 A * 9/1989 Narang ..... 122/14.1
5,413,088 A 5/1995 Oviatt
5,662,468 A * 9/1997 Henderson ..... 431/302
5,772,425 A * 6/1998 Henderson ..... 431/319
5,899,682 A * 5/1999 Henderson et al. ..... 431/12
5,967,765 A * 10/1999 Henderson et al. ..... 431/12
6,254,380 B1 * 7/2001 Henderson et al. ..... 431/21
2001/0051321 A1 * 12/2001 La Fontaine ..... 431/12

* cited by examiner

*Primary Examiner*—Alfred Basichas
(74) *Attorney, Agent, or Firm*—Margaret Polson; Patent Law Offices of Rick Martin, P.C.

(57) ABSTRACT

The present invention has an inner and outer hull spaced apart, so that burner intake air may flow between the inner and outer hull. The inner hull has the burner mounted in the bottom in a known manner with an air intake port placed below the burner. A burner ring is mounted above the burner to control the air drafts around the burner. On the inner hull one or more barometric draft valves are placed above the burner. As the air pressure rises, due to increasing wind speed, gas pressure, etc., the barometric valve opens automatically, providing more air to feed the flame and reducing the draft under the burner, thereby preventing the flame from being blown out. In extreme locations, more than one barometric draft valve can be provided. The valves can be set to open at different pressures, allowing for an even greater range of operating conditions.

13 Claims, 3 Drawing Sheets

EXCESS GAS BURNER

CROSS REFERENCE APPLICATIONS

This application is a non-provisional application claiming the benefits of provisional application No. 60/380,368 filed May 14, 2002.

FIELD OF INVENTION

The present invention relates to the burning off of excess natural gas, or other flammable gases, at gas and oil wells and other locations.

BACKGROUND OF THE INVENTION

There are a number of places where it is necessary or desirable to burn off excess natural gas or other flammable gases. The oil and natural gas industries both do burns in the drilling and refining processes. A common place where excess natural gas needs to be burned off is in high-pressure gas well systems, which are well known in the art. A standard part of the operation of these systems is to reduce excess gas pressure by burning off excess gas, which is a frequent occurrence. A number of known systems are used presently used to burn off the excess gas. A standard design of the combustors used is to have a standard burner placed at the bottom of a simple chimney or stack. An air intake hole is cut in the stack below the burner to allow air to continually feed the flame.

These systems have a number of problems, particularly in extreme conditions. Conditions that cause problems for these prior art systems include high-altitude, large temperature ranges, variable wind speed, low wind speed, and burn off gas flow rates that range from very low to very high (80 mcf/d). Any one of these conditions, or a combination of them, can cause the burner flame to be blown out, causing the excess gas to be vented directly into the atmosphere. In addition, many of these gas wells are in remote locations, where it is difficult to monitor the combustor and hard to send someone out to re-light the burner.

Another problem that can occur is incomplete combustion of the gasses. As gas flow increases, the draft through the air intake hole and up the chimney increases, and incomplete combustion of the gas occurs, also resulting in gas being released into the atmosphere.

With a single hulled chimney design, the chimney can get very hot during use. If the chimney is not insulated, this can cause brush fires in remote locations as dead plant material, like tumble weeds, are blown up against the chimney. The chimneys can be insulated, but the insulation material is often expensive and can often be harmful to the environment itself.

The present invention provides for reduce chances of flame blowout, more complete combustion and cooler chimneys.

SUMMARY OF THE INVENTION

The primary aspect of the present invention is to provide a combustor that will operate in a large variety of conditions with a minimum of human intervention.

Another aspect of the present invention is to provide a combustor that will burn off most of the excess gas in a wide variety of conditions.

Other aspects of this invention will appear from the following description and appended claims, reference being made to the accompanying drawings forming a part of this specification wherein like reference characters designate corresponding parts in the several views.

The present invention has at least an inner and outer stack hull spaced apart, so that air may flow between the inner and outer hull. The inner hull has the burner mounted in the bottom of the hull in a known manner with an air intake placed below the burner, as in the prior art system. A burner ring may be mounted above the burner to control the air drafts around the burner. On the inner hull one or more barometric draft control valves (barometric valves) are placed above the burner. As the air pressure rises, due to increasing wind speed, gas pressure, etc., the barometric valve opens automatically, providing more air to feed the flame and reducing the draft up the stack, thereby preventing the flame from being blown out. The location of the barometric valve also provides extra air to the flame to allow for complete combustion, while reducing the draft. In extreme locations, more than one barometric valve can be provided. The valves can be set to open at different pressures, allowing for an even greater range of operating conditions.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 3:
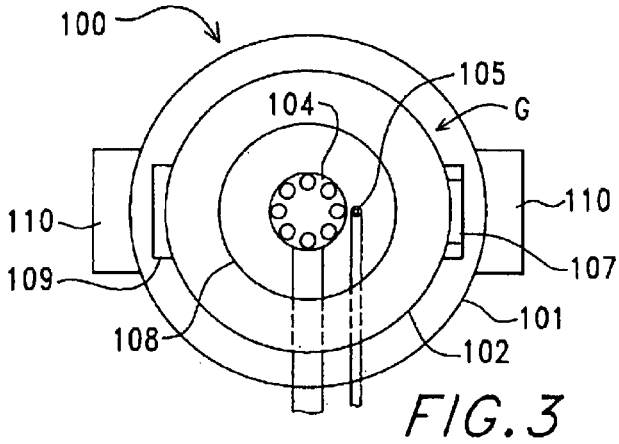
FIG. 3 is a top plan view of FIG. 1.
Figure 1:
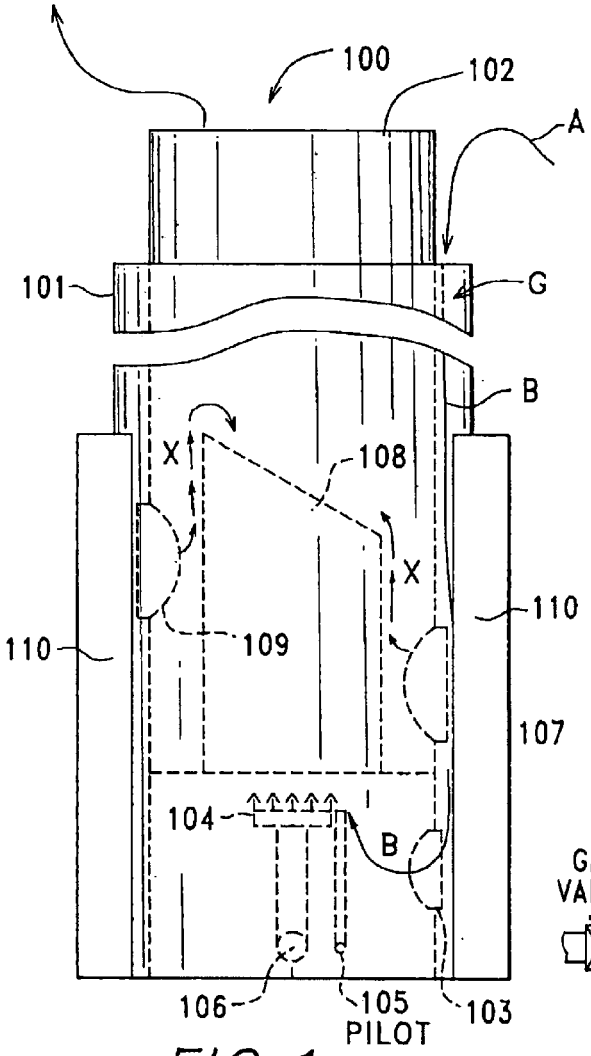
FIG. 1 is a front plan view with the internal parts shown in dotted lines of one embodiment of the present invention.
Figure 2:
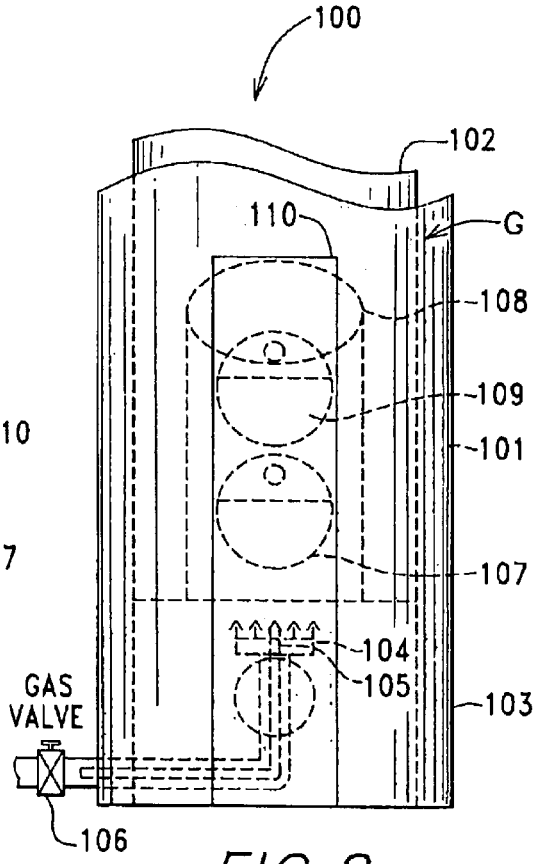
FIG. 2 is a side plan view with the access door removed and the internal parts shown in dotted lines of the embodiment shown in FIG. 1.

Referring first to FIGS. 1 and 2, the combustor 100 has an outer hull 101, and inner hull 102 which together form the stack. The outer and inner hull, 101, 102, are spaced apart, allowing intake air to flow freely between them via gap G, as shown by arrow A. The inner hull 102 has a primary air intake port 103 spaced below the burner 104. The burner 104 can be selected from a number of standard, known in the art burners and, therefore, will not be described in detail. Next to the burner 104 is a pilot 105, which functions in a known manner to light the burner 104 when gas is flowing. A pipe attached to a gas valve 106, which is attached to the gas well or other supply in a known manner, supplies both the burner 104 and the pilot 105. The primary air intake 103 is always open, and can simply be a hole cut in the inner hull 102. The gas supply and the control of when to light the burner are all known in the industry and will not be described.

When the combustor 100 is burning the airflow will be down between the inner and outer hull 102, 101, in gap G through the primary air intake 103, and up inner hull 102, as shown by arrow B. The more gas in being burned, the greater the heat, the greater the draft, as is well known the art. The inner hull 10*e* will heat up during a burning operation. As the air flows between the inner hull 102 and the outer hull 101 the air will cool the inner hull 102 and be heated. This pre-heating of the air increases the efficiency of the burning of the gas in a known manner and counteracts the environmental low air temperatures found in some locations. The outer hull 101 also reduces the temperature of the outer surfaces of the combustor 100. This reduces the chance of injury to an operator or an accidental fire caused by dry vegetation, such as tumbleweed, resting against the combustor 100. Access doors 110 can be provided on outer hull 101 to allow access to the working parts of the combustor 100 for maintenance.

Spaced above the burner 104 is a barometric valve 107. As the rate of gas flow increases, and/or the atmospheric wind speed increases, the draft up the inner hull 102 increases in a known manner, increasing the air pressure inside the inner hull 102. As the air pressure increases to a set level, barometric valve 107 opens, increasing the amount of airflow while reducing the speed of the airflow. This prevents the burner 104 from being blown out while simultaneously increasing and/or maintaining the completeness of the combustion of the gas.

In the disclosed embodiment, the barometric valve is the draft controller built by Field Controls, Inc. of Kinston, N.C. Other similar products are believed to work as well.

Figure 6:
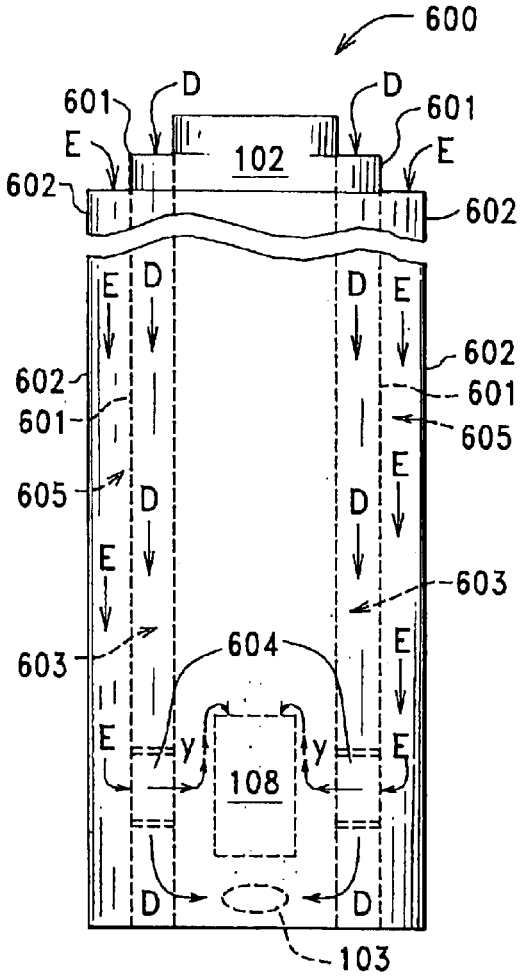
FIG. 6 is a front plan view of a third embodiment of the present invention with the internal parts shown in dotted lines.

As the barometric valve 107 is placed above the burner 104 the draft of air will not be flowing up through the flame and cannot blow the flame up off the burner, blowing out the flame. Burner ring 108 further protects the flame from the airflow from barometric valve 107 and helps to create the helix-shaped flow of gases which is known to enhance the combustion process. The burner ring can be slanted at the top edge as shown in FIG. 1 or straight as shown in FIG. 6.

If needed for proper airflow, one or more additional barometric valves 109 can be provided. The barometric valves can be set to open at different pressures or at the same pressure. The number of valves needed and the range of pressures at which they open will be determined by the range environmental conditions at the combustor location. Units can be built to accommodate a range of conditions, or specific units can be custom made for each location.

The barometric valves 107, 109 are placed such that the airflow from them will hit the side of the burner ring 108, dissipating the force of the airflow and further heating the air and cooling the burner ring 108. Therefore, the barometric valves are not placed either above or below the burner ring 108 on the hull. The air then flows over the edge of the burner ring into the combustion area as shown by arrows X in FIGS. 1 and 4.

The additional flow of air, provided by the barometric valves at the site of the combustion, allows for more complete combustion of the gases, as sufficient oxygen for complete combustion is almost never provided by the primary air intake 103, except at low gas flow rates. The location of the barometric valve next to the site of combustion allows the simultaneous prevention of blowouts and increased combustion of gasses.

Figure 8:
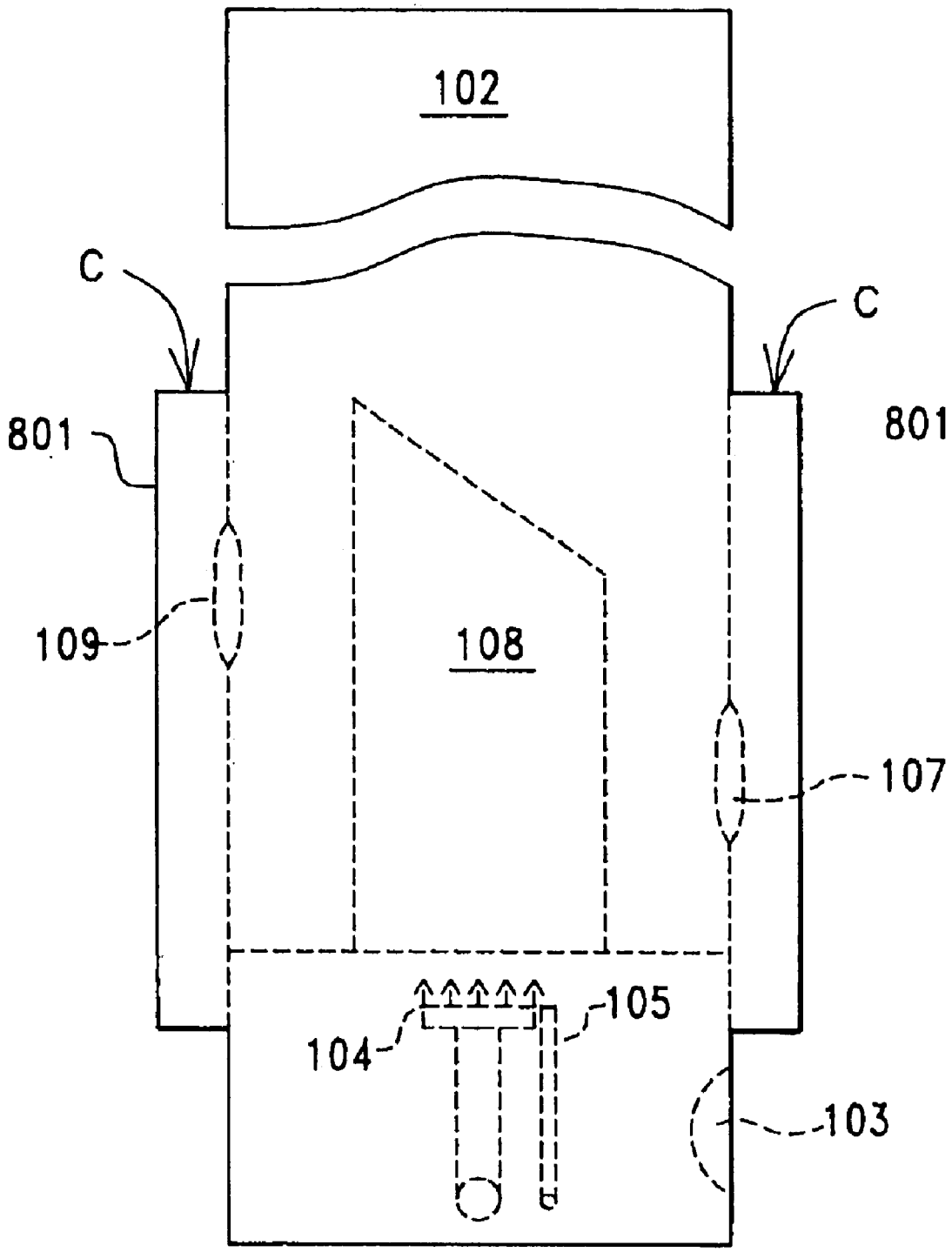
FIG. 8 is a front plan view of a fourth embodiment of the present invention with the internal parts shown in dotted lines.

In an alternate embodiment of the present invention shown in FIG. 8, the outer hull 101 can be replaced with covers 801 that just cover the barometric valve or valves 107. The covers help to regulate the air pressure and reduce the chance of the barometric valve 107 being opened unnecessarily. The tops of the covers 801 are open to allow airflow as shown by arrows C.

Figure 5:
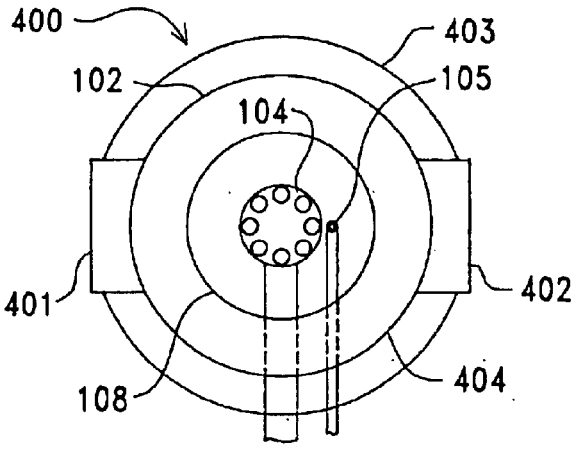
FIG. 5 is a top plan view of FIG. 4.
Figure 4:
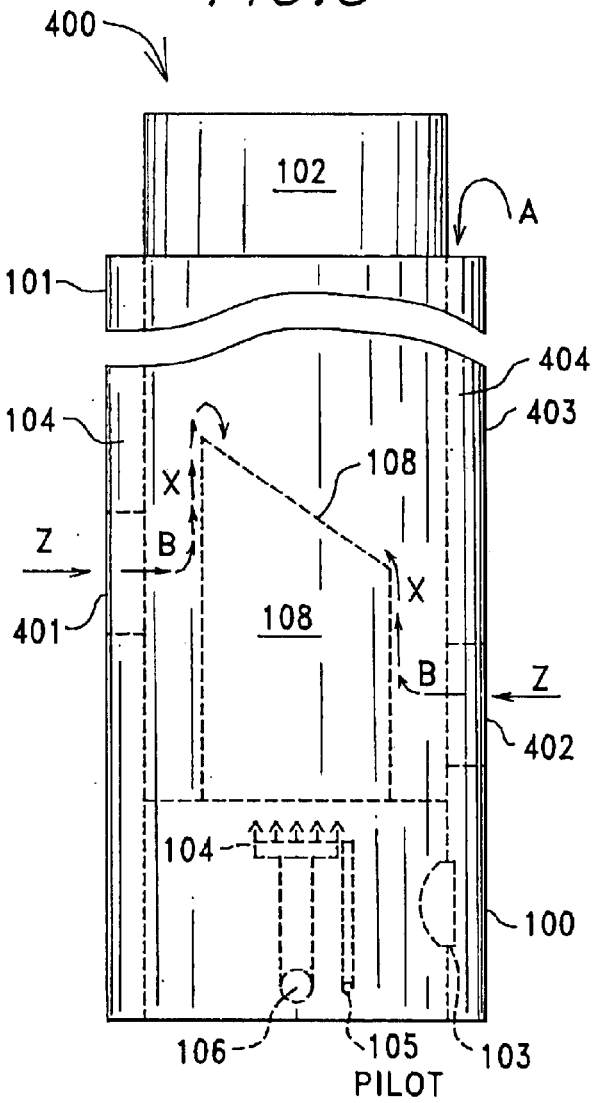
FIG. 4 is a front plan view of a second embodiment of the present invention with the internal parts shown in dotted lines.

In some types of conditions, such as some higher gas flow rates, a majority of the air flowing between the hulls 101, 102 was pulled in to the barometric valves 107 and 109, and not enough air was flowing into the primary air intake 103 in the first embodiment of the combustor 100. FIGS. 4 and 5 show an alternate embodiment of the combustor 400 to prevent this problem. In this embodiment the barometric valves 401 and 402 extend through the inner hull 102 and the outer hull 403 and draw air directly from the surrounding air, as shown by arrows Z. As described above the barometric valves 401 and 402 are located next to the burner ring 108.

The combustion air is still drawn down between the hulls 102 and 403 in space 404, to the primary air intake 102 as shown by arrow A. This design allows for greater airflow through the barometric valves 401, 402 and prevents the airflow to the primary air intake 103 being limited. As in the previous embodiments, one or more barometric valves can be used, depending on the amount of airflow needed for a given application.

Since the air flowing into the barometric valves 401, 402 is not heated by flowing along the inner hull 101, as in the previous embodiment, this provides for cooling of the exhaust gasses by the combining with the atmospheric temperature air. This also prevents the excess heating of the hulls and the exhaust gasses.

Figure 7:
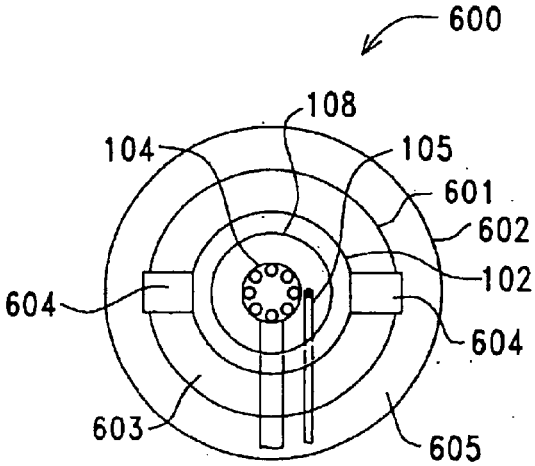
FIG. 7 is a top plan view of FIG. 6.

For some very large combustors the heat put off is quite substantial. In addition, in some applications it is necessary to prevent the intake air from being drawn near to the ground. This is to prevent any leaks of natural gas from the well and other equipment from being drawn into the burner area and causing a flash fire. In these types of situations a three-hulled design of the combustor 600 can be used, as shown in FIGS. 6 and 7. The inner hull 102, burner 104, pilot 105, burner ring 108 and the primary air 103 intake are the same as in the previous embodiments. The burner 104 and the pilot 105 have been omitted from FIG. 6 for clarity. There is a middle hull 601 and an outer hull 602. Both hulls are open at the top as shown in FIG. 7. All the air flowing to the primary air intake 103 flows in space 603 between the inner hull 102 and the middle hull 601 as shown by arrows D.

The barometric valves 604 extend through the inner hull 102, across space 603 and through middle hull 601. As in the previous embodiments, one or more barometric valves 603 can be used, depending on the amount of airflow needed, and the barometric valves are placed next to the burner ring 108. The airflow for the barometric valves 603 flows in space 605 between the middle hull 601 and the outer hull 602 as shown by arrows E. The airflow then impacts the burner ring and flows over the edges of the burner ring into the combustion area, as shown by arrows y. The airflow y will be up over the top of the burner ring for the most part due to the overall draft of air up the hull. The triple hulls and the airflows D and E all act to help prevent the outer hull 602 from overheating during operation of the combustor 600.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An excess gas burner assembly, said assembly comprising:

an outer hull;

an inner hull inside the outer hull;

an air space between the outer and inner hull to provide an air inlet flow in the air space;

said inner hull having an inlet port to a combustion chamber;

said combustion chamber having a burner with a gas inlet;

said burner having a burner ring mounted above it to control air flow to a flame on the burner; and at least one barometric valve mounted in the inner hull above the burner, at a height between a top and bottom edge of the burner ring and next to the burner ring to regulate air flow in the combustion chamber.

2. The excess gas burner assembly of claim 1 further comprising at least two barometric valves mounted in the inner hull at different heights between the top and bottom edge of the burner ring.

3. The excess gas burner assembly of claim 1 further comprising at least two barometric valves mounted in the inner hull at the same height between the top and bottom edge of the burner ring.

4. The excess gas burner assembly of claim 1 further comprising at least one access door mounted in the outer hull to allow access to the at least one barometric valve and burner.

5. The excess gas burner assembly of claim 1, wherein the top edge of the burner ring is slanted.

6. The excess gas burner assembly of claim 1, wherein the at least one barometric valve is mounted to extend through the inner and outer hull, providing an air flow of outside air to the combustion chamber.

7. An excess gas burner assembly, said assembly comprising:

an outer hull;

a middle hull inside the outer hull an inner hull inside the middle hull;

a first air space between the outer hull and middle hull to provide an air inlet flow in the air space;

a second air space between the middle hull and inner hull to provide a seond air flow inlet in the second air space;

said inner hull having an inlet port to a combustion chamber;

said combustion chamber having a burner with a gas inlet;

said burner having a burner ring mounted above it to control air flow to a flame on the burner; and at least one barometric valve mounted in the middle hull and extending through the inner hull above the burner, at a height between a top and bottom edge of the burner ring and next to the burner ring to regulate air flow in the combustion chamber.

8. The excess gas burner assembly of claim 7 further comprising at least two barometric valves mounted in the middle hull at different heights between the top and bottom edge of the burner ring.

9. The excess gas burner assembly of claim 7 further comprising at least two barometric valves mounted in the middle hull at the same height between the top and bottom edge of the burner ring.

10. The excess gas burner assembly of claim 7 further comprising at least one access door mounted in the outer hull to allow access to the at least one barometric valve and burner.

11. The excess gas burner assembly of claim 7, wherein the top edge of the burner ring is slanted.

12. An excess gas burner assembly, said assembly comprising:

a hull;

said hull having an inlet port to a combustion chamber;

said combustion chamber having a burner with a gas inlet;

said burner having a burner ring mounted above it to control air flow to a flame on the burner; and at least one barometric valve mounted in the hull above the burner, at a height between a top and bottom edge of the burner ring and next to the burner ring to regulate air flow in the combustion chamber;

a cover mounted on the hull over the at least one barometric valve, said cover being open at least one edge; and an air space between the hull and the cover to provide an air inlet flow in the air space.

13. An excess gas burner assembly, said assembly comprising:

an outer hull means functioning to provide an outer structure around a gas burner;

at least one inner hull mans inside the outer hull means;

each of said inner hull means functioning to provide an vertical air inlet to the gas burner;

eachof said inner means hull having an inlet port to the gas burner;

said gas burner having a burner ring means mounted above it and functioning to control air flow to the gas burner; and at least one barometric valve means mounted in at least one inner hull above the gas burner, at a height between a top and bottom edge of the burner ring means and next to the burner ring means to regulate air flow in the combustion chamber.

* * * * *